United States Patent [19]

Bay

[11] 4,089,658

[45] May 16, 1978

[54] COAL EXTRACTION AND FUEL ADDITIVE MADE THEREFROM

[75] Inventor: Eugene Howard Bay, Panama City Beach, Fla.

[73] Assignee: B.D.F. Ltd., Lanham, Md.

[21] Appl. No.: 721,300

[22] Filed: Sep. 8, 1976

[51] Int. Cl.[2] ..... C10L 1/26

[52] U.S. Cl. ..... 44/56; 44/50; 44/80; 208/8; 208/15

[58] Field of Search ..... 44/51, 50, 80, 56; 208/8

[56] References Cited

U.S. PATENT DOCUMENTS

| | | | |
|---|---|---|---|
| 2,141,615 | 12/1938 | Pott | 208/8 |
| 2,173,842 | 9/1939 | Horner | 208/8 |
| 3,018,241 | 1/1962 | Gorin | 208/8 |
| 3,598,718 | 8/1971 | Gleim et al. | 208/8 |
| 3,748,254 | 7/1973 | Gorin | 208/8 |
| 3,976,438 | 8/1976 | Bay | 44/61 |

*Primary Examiner*—Daniel E. Wyman
*Assistant Examiner*—Mrs. Y. Harris-Smith

[57] ABSTRACT

A process for extracting coal is provided which includes contracting coal with an admixture of water, an organic solvent, and carbon tetrachloride, and separating the organic solvent containing the coal extract. The coal extract is useful as a gasoline additive.

4 Claims, No Drawings

COAL EXTRACTION AND FUEL ADDITIVE MADE THEREFROM

BACKGROUND OF THE INVENTION

This invention relates to a process for extracting from coal a material which is especially effective as a gasoline additive, to the extracted material, and to gasoline additive compositons and fuel compositons prepared therewith. In particular, the present invention provides a gasoline additive which effectively increases the duration of motor operation obtainable with a given amount of fuel.

Many processes using many solvents have been proposed for the solvent extraction of coal and uses for the extract or its conversion to valuable hydrocarbons, usually by hydrogenation, described. For example, U.S. Pat. No. 1,822,349 teaches many solvents for coal extraction; U.S. Pat. No. 2,141,615 teaches the use of solid coal extracts as powdered fuel in combustion engines; U.S. Pat. No. 2,215,190 teaches hydrogenating coal extract to produce gasoline, diesel oil, lubricating oil, and the like. The complex composition of coal and the complexity of extracts thereof are also well recognized (U.S. Pat. Nos. 3,379,636, 3,162,594 and 3,018,241, for example). A summary and discussion of the solvent extraction of coal is provided by *Chemistry of Coal Utilization,* Supplementary Volume, H. H. Lowry, Editor, published by John Wiley & Sons, Inc. (1963), especially pages 237 through 252; certain uses for coal extracts are discussed on page 250, and the remarkably few commercial applications are indicated on page 252.

SUMMARY OF THE INVENTION

An object of the present invention is to provide a novel process for extracting coal to produce a hydrocarbonaceous product valuable in small amounts as a fuel additive.

A further object is to provide a fuel additive composition containing the novel coal extract.

A particular object is to provide a novel gasoline composition containing a minor amount of a coal extract which gives enhanced mileage per gallon in automobile operation.

In an embodiment of the present invention, coal particles are slurried with a liquid mixture containing a predominant amount of water, a minor amount of an organic solvent, and a still smaller quantity of carbon tetrachloride. After thorough admixing, the system is allowed to become quiescent. An additional quantity of the solvent and carbon tetrachloride is then preferably added with thorough mixing of the system which is then maintaine quiescent and separates into a lower water layer (containing at least a major portion of the carbon tetrachloride) and an upper hydrocarbon layer. The upper layer, containing the coal extract, is then separated. Substantially all or a portion of the solvent used may be recovered by distillation, but preferably the entire layer containing the coal extract may be used as the gasoline additive with good results as hereinafter described. The coal extract is always preferably handled as a solution of colloidal dispersion in an organic solvent. As above mentioned, the solvent for the extraction, or a portion thereof, is preferably used as the fuel additive, and other materials such as a petroleum naphtha, an alcohol, and/or tricresylphosphate, added thereto to form a gasoline additive composition. In general, any gasoline additive may be used in addition to the coal extract of the invention and good results obtained. Good results are obtained with leaded or unleaded gasoline. Also, other fuels such as diesel fuel and furnace oil benefit from the presence of the coal extract, and known additives for improved performance such as cetane improvers may also be used in such fuel compositions. Preferably the petroleum naphtha used in the extraction step has a boiling range compatible with the boiling range of the fuel, so that it can be added directly to the fuel.

DETAILED DESCRIPTION OF THE INVENTION

The coal which can be used in the present process includes all kinds of coal, e.g. bituminous coal, lignite, sub-bituminous coal, etc., but equivalent results are not necessarily obtained. Bituminous coal is the preferred material to use and substantially uniform results are obtained therewith. Although not essential to the invention, it is preferred that the coal be crushed to a particle size not greater than an average of 1 inch in diameter, and preferable to "pea" size, i.e. to an average diameter of about $\frac{1}{8}$-$\frac{1}{4}$ inch. If desired, the coal may be used in comminuted form, in which instance the coal may be pulverized to particles which remain, however, sufficiently large so that they will settle to the bottom of the tank during the quiescent period.

The extraction is carried out with a mixture of a predominant amount of water, an organic solvent and a small amount of carbon tetrachloride. The organic solvent is a petroleum naphtha, by which is meant a petroleum fraction composed predominately of hydrocarbons boiling in the range of from about 200° F to about 500° F. A mixture of naphthas of different boiling ranges, preferably one boiling in the upper portion and one in the lower or middle portion of said range, gives good results, in which event there may be hiatus in the boiling ranges or they may overlap. For example, a mixture of about equal parts of a naphtha prepared from crude oil by straight distillation and having an initial boiling point of 350°-368° F; a 5% point of from 368°-378° F; and an end point of 386°-396° F; and having a specific gravity (60° F) of 0.789 with a naphtha having a lower boiling range of from about 200° F to 300° F is especially suitable. Other solvents are preferably added, including ketones such as acetone, methylethyl ketone and methylisopropyl ketone; aromatic hydrocarbons such as benzene, toluene and xylenes; alcohols such as methyl or isopropyl alcohol; ethers such as dimethyl ether, methylethyl ether, and diethyl ether, and other known solvents including indane, tetrahydronaphthalene, and the like. It is known that the yield and nature of a coal extract depends on the solvent or solvents used, the conditions of extraction, and the composition of the coal. As has been found, however, the objectives of the present invention may be obtained so long as coal is extracted using a predominate amount of water, a minor portion of a petroleum naphtha, and a still smaller portion of carbon tetrachloride, using vigorous admixing of the system followed by a quiescent or soaking period during which period organic and water layers separate. The roll of the carbon tetrachloride is not known, but its presence and contact with the coal during the extraction step appears essential to the present invention.

In the extraction step, for each pound of coal from 5 to 50 pounds of water, and preferably from 10 to 20 pounds of water, are used. For each 100 parts by volume of water, from 2 to 20 parts by volume of organic solvent are used, together with from 0.25 to 10 parts by volume of carbon tetrachloride. Other solvents such as acetone, benzene, toluene, etc., when used should, for each 100 parts by volume of water, be present in an amount of from about 0.5 to 3 parts by volume with a total volume thereof not exceeding about 20 parts by volume.

Numerous variations in the extraction step are possible. In its simplest form the coal, water, carbon tetrachloride and organic solvent are vigorously mixed for a time sufficient to accomplish the extraction. The mixture is then maintained quiescent to form two layers, an upper layer of the organic solvent containing the desired coal extract and a lower water layer including most of the carbon tetrachloride. The upper layer is then separated and used per se as a fuel additive, or is further treated usually for recovery of all or part of the organic solvent or solvents for reuse in the process. The interface may not be sharply defined and may be separated as a separate layer containing any coal fines present or resulting from the process. This layer has valuable properties as a fuel extender.

The optimum time of mixing varies substantially depending on the size of the coal particles, the vigor of the mixing and the temperature of the mixture. Small coal particle size and vigorous mixing lower the time required, but generally a time of at least one hour is used, and a longer and even considerably longer time, say up to 48 hours or more, gives good results. The temperature used in the extraction step is not considered critical, and ambient temperature is preferred. However, use of an elevated temperature, say up to about 150° F, lowers somewhat the time required for extraction. The mixture should be maintained well below the boiling points of the liquid components unless means is provided to condense and return vapors or unless a pressure vessel is used. A temperature of from about 68° F to 72° F gives good results.

In a preferred embodiment of the invention, the extraction step is carried out by periodic mixing, each mixing time followed by a soaking, or quiescent, time. The use of at least two mixing times, and preferably from four to twenty mixing times, each followed by a soaking time sufficient for two layers to separate is preferred to best achieve the objectives of the invention. In this preferred embodiment it is advantgeous to add, at an intermediate step, an additional quantity of the organic solvent, the amount being from 1/4 to 4 times the volume initially added. The composition of the additional amount of organic solvent may be the same as in the initial contacting, or different if convenient or if a desired result, say an enhanced yield of coal extract, is thereby obtained. The above noted organic solvents in addition to petroleum naphtha are advantageously present as described for the initial contacting. It is preferred to add additional solvent after the extraction has been at least one-half completed as to the total time involved, but before the final mixing step.

The use of a soaking time, and preferably a series thereof, appears important to the present invention. While quiescent, an upper layer of organic solvent separates from a lower water layer with the coal and carbon tetrachloride in contact at the bottom of the water layer. This contacting appears important to the process of the invention. During mixing, coal extract is removed from the coal, or from the carbon tetrachloride, or both, at least in part by the organic solvent. The organic solvent containing the coal extract is then used per se as a gasoline additive, or as a component of a gasoline additive, or it is further treated such as for recovery of solvent which is reused in the process. The carbon tetrachloride may to an extent be dissolved by one or more of the organic solvent components, but the presence of the predominate amount of water in which the carbon tetrachloride is only very slightly soluble, prevents such loss from becoming significant.

The amount of extract removed from the coal is believed to vary from about 1% to about 15% by weight of the coal, and this does not appear critical to the present invention. In the event the amount of extract in the solvent layer is not sufficient, when added to the fuel, to give the desired result, an additional quantity may be added thereto, and if desired process conditions may be adjusted to increase the amount of the extract up to a maximum for a given operation.

In general, the amount of extract present in the upper layer will vary from about 0.5 to 30 wt. percentage, or more.

As above stated, the separated organic layer containing the coal extract is preferrably compounded into a gasoline additive composition by blending with other materials. A preferred composition, for example, contains from 0.2 to 2 parts of organic solvents containing the extract (upper layer) with from 30 to 50 parts of a petroleum naptha boiling in the range of from about 200° F to 300° F, 15 to 25 parts of ortho-dichlorobenzene, from 2 to 10 parts of tricresylphosphate, and from 2 to 10 parts of isopropyl alcohol.

The apparatus to use in the extraction step of the present process may be any suitable vessel such as a rocking vessel which may be a rocking autoclave where elevated temperatures and pressures are desired. However, a variety of vessels which include some means for admixing the system components, such as by stirring or other agitation, are suitable. Although mechanical agitation is preferred, other means such as the addition of calcium carbide can be used. The acetylene generated by reaction between the calcium carbide and water provides vigorous agitation and appears to assist in the extraction step.

In the following Examples, "parts" means parts by volume, and "oz" means fluid ounce.

EXAMPLE 1

To a vat was added 100 parts (342 pounds) of water, 2.44 parts of petroleum naptha, 1.22 parts acetone, 1.22 parts toluene, 1.22 parts benzene and 0.61 part carbon tetrachloride. Twenty-five pounds of bituminous coal (about two inches diameter average lump size) were introduced into an open-weave basket fitting the vat. About ⅛ pound of calcium carbide was introduced near the bottom of the system immediately prior to introducing the coal, and again 3 hours after the coal introduction. The gas generated provided vigorous mixing for about 4 minutes in both instances. The system was maintained quiescent and after 7 days 2.44 parts of acetone was added and 8 days thereafter were added the following: 2.44 parts toluene; 4.88 parts benzene; 3.05 parts of a petroleum naptha having a boiling range from about 310°–378° Fahrenheit; 3.66 parts acetone, and 1.83 parts of carbon tetrachloride. Vigorous mechanical mixing was supplied. The mixture was maintained quiescent for about 10 days at which point 0.15 part of each of the immediately above solvents were added with vigorous mechanical mixing. Mechanical mixing was thereafter supplied daily for about 50 days. The layers were then allowed to separate.

The system was maintained quiescent for about 18 days. The coal was then removed from the system and dried. The dried coal was weighed; a loss of about 10% from the original weight was observed. The coal was replaced in the system and 1/4 pound of calcium carbide was added as before. Vigorous mixing was obtained for about 6 minutes. The system was then allowed to be quiescent for an extended period of several days during which an upper (organic) layer and a lower (water) layer separated. The upper layer, consisting of the organic solvents and coal extract was removed by skimming and was useful as a gasoline additive as described below.

EXAMPLE 2

The procedure of Example 1 was substantially repeated using the same amounts of the same components. However, only one addition of solvents after the first mixing was made (after 10 days) and the total time was reduced to 15 days. Mechanical mixing was applied daily. After a final quiescent period, the upper layer was removed by skimming.

To obtain an additional quantity of extract, the above was repeated by adding 25 pounds of fresh coal to the original coal and the above-designated organic solvents in the amounts stated except that no toluene was added and the original water containing the original carbon tetrachloride was used. After following the above procedure, the upper layer was removed by skimming and mixed with the above-obtained layer. In this Example this mixture of solvents and coal extract (upper layer) is designated "concentrate." A portion of the concentrate was blended with a mixture of other materials to form a "concentrate mixture" as follows: 40 oz mineral spirits (a petroleum naptha boiling in the lower temperature range, as herein defined, of from about 200° F to 300° F), 20 oz o-dichlorobenzene, 5 oz tricresylphosphate, 5 oz isopropyl alcohol and 1 oz concentrate.

The motor used was a Briggs-Stratton, four cycle, 3 1/2 horsepower engine designed to power a lawn mower. The fuel used was a commercially available regular grade leaded gasoline, having an octane rating of about 90, in this example designated "gasoline." Throughout the following tests the throttle was maintained constant. The fuel tank of the motor was flushed with gasoline and drained. To insure that the motor was warm, an additional quantity of gasoline was introduced into the tank and the motor operated until the fuel was exhausted. The following series of tests were then performed:

a. Six ounces of gasoline were introduced into the tank. The motor was started and allowed to run until the gasoline was consumed. The time of the operation was 8.96 minutes. The procedure was twice repeated with the times of operation being 10.25 minutes and 12.57 minutes; the average of the three runs was 9.61 minutes.

b. The procedure of (a) was repeated with (4 drops) concentrate added to the 6 oz (less 4 drops) of gasoline. The time of operation was 13.67 minutes, an improvement of 30% over the results obtained without the concentrate. It was also noted that, although the throttle setting was maintained constant, the revolutions per minute of the motor was increased from 3000 observed in (a) to 3300 as measured by a mechanical tackometer.

c. The procedure of (a) was repeated using as the fuel a mixture of 4 oz gasoline and 2 oz of concentrate. A running time of 10.27 minutes was obtained. On repeating, a running time of 14.07 was obtained. The average time was 12.17, a decrease of 11% from the time obtained in (b), but an increase of 21% over the time obtained of (a). The concentrate was apparently above the optimum for the fuel.

d. The procedure of (a) was repeated using as the fuel 2 drops of concentrate mixture added to the 6 oz. (less 2 drops) of gasoline. A running time of 12.33 minutes was obtained.

e. The procedure of (a) was repeated using as the fuel a mixture of 4 oz. of gasoline and 2 oz. of concentrate mixture. A running time of 15.78 minutes was obtained. On repeating, a running time of 14.12 minutes was obtained. The average running time was 14.95 minutes, an improvement of 35% over the running time of (a).

f. The procedure of (a) was repeated using as the fuel 4 oz. of gasoline and 2 oz. of concentrate mixture in which the concentrate had been omitted. A running time of 12.58 minutes was obtained. On repeating, a running time of 15.58 was obtained. The average running time was 14.08 minutes, the running time obtained in (e) was 5.8% above the running time here obtained.

g. The procedure of (a) was repeated using as the fuel 6 oz. of the concentrate mixture. The motor would not start. On repeating using 6 oz. of the concentrate mixture of a composition as defined except that no concentrate was added, the motor again would not start.

EXAMPLE 3

The operation of 1974 model Cadilac Sedan de Ville on commercially available (regular grade) gasoline was compared with operation with the same gasoline having 2 fluid ounces of concentrate mixture added per 20 gallons of gasoline. Driving was under all conditions over an 8 month period. Periodically, the addition of the additive was discontinued to obtain the results described herein. Without the additive, an average of 9.5 to 10 miles per gallon was obtained. With the additive, an average of 13 to 13.5 miles per gallon was obtained.

EXAMPLE 4

To a vat were added 100 parts of water, 2.37 parts acetone, 0.79 part each of toluene, benzene, and carbon tetrachloride, and 1.58 parts of petroleum naphtha boiling inthe range of from about 100° F to 200° F. Coal was not used. The liquids were vigorously admixed and allowed to settle. The upper layer was separated by skimming, tested as a gasoline additive (called "layer" in this Example 4), and compared to results obtained with the coal extract of Example 2. Also included are data obtained with the concentrate mixture of Example 2, made without the concentrate, i.e., the mixture did not contain any coal extract, and is designated herebelow as "mix;" "concentrate" and "concentrate mixture" have the same meanings as Example 2. The gasoline and motor used were the same as in Example 2. After a motor warm-up period of 20 minutes, the following series of runs were made; the throttle position was the same throughout:

a. 6 oz of gasoline: 15.5 minutes
b. 4 oz of gasoline + 2 oz mix: 21.62
c. 4 oz gasoline + 2 oz mix: 21.2
d. 4 oz gasoline + 2 oz mix: 20.33
e. 4 oz gasoline + 2 oz layer: 19.77
f. 4 oz gasoline + 2 oz concentrate mixture: 23.1 g. 4 oz gasoline + 2 oz concentrate mixture made with layer, i.e., with no coal: 16.83

These data show the value of the coal extract gasoline additive of the invention.

The invention claimed is:

1. Process of extracting coal which comprises admixing coal, water, petroleum naphtha and carbon tetrachloride, wherein for each pound of coal from 5 to 50 pounds of water are used, and wherein for each 100 parts by volume of water from 2 to 20 parts of petroleum naphtha and from 0.25 to 10 parts by volume of carbon tetrachloride are used, and separating petroleum naphtha containing from about 0.5 to 30 weight percent coal extract from the remaining components.

2. A fuel composition comprising gasoline, diesel fuel or furnace oil containing a fuel additive amount of petroleum naphtha containing coal extract prepared according to claim 1.

3. The coal extract prepared according to the process of claim 1.

4. A gasoline additive composition containing, in parts by volume, from 30 to 50 parts of a petroleum naphtha boiling in the range of from about 200° F to 300° F, from 15 to 25 parts of ortho-dichlorobenzene, from 2 to 10 parts of tricresylphosphate, from 2 to 10 parts of isopropyl alcohol, and from 0.2 to 2 parts of the organic solvent containing coal extract prepared by the process of claim 1.

* * * * *